US005505136A

United States Patent [19]

Cauchetier et al.

[11] Patent Number: 5,505,136

[45] Date of Patent: Apr. 9, 1996

[54] CORE-GENERATING CHARGE WITH MEANS FOR CORRECTING ENTRAINMENT ROTATION EFFECTS

[75] Inventors: Jean Cauchetier, Paris; Jean-Pierre Frehaut, Versailles, both of France

[73] Assignee: Thomson-Brandt Armements, La Ferte St Aubin, France

[21] Appl. No.: 902,371

[22] Filed: Jun. 22, 1992

[30] Foreign Application Priority Data

Jun. 21, 1991 [FR] France ..... 91 07690

[51] Int. Cl.[6] ..... F42B 12/14

[52] U.S. Cl. ..... 102/476; 102/307; 102/309; 102/701

[58] Field of Search ..... 102/476, 475, 102/306, 309, 701, 387, 307

[56] References Cited

U.S. PATENT DOCUMENTS

| | | | |
|---|---|---|---|
| H1,011 | 1/1992 | Kline | 102/476 |
| 4,538,519 | 9/1985 | Witt et al. | 102/387 |
| 4,590,861 | 5/1986 | Bügiel | 102/307 |
| 4,610,204 | 9/1986 | Dunne et al. | 102/476 |
| 4,702,171 | 10/1987 | Tal et al. | 102/307 |
| 4,841,864 | 6/1989 | Grace | 102/309 |
| 4,922,825 | 5/1990 | Aubry et al. | 102/476 |
| 5,003,882 | 4/1991 | Frehaut et al. | 102/387 |

FOREIGN PATENT DOCUMENTS

| | | |
|---|---|---|
| 0244527 | 11/1987 | European Pat. Off. . |
| 2632394 | 12/1989 | France . |
| 3420045 | 2/1991 | Germany . |
| 2176878 | 1/1987 | United Kingdom . |

*Primary Examiner*—Harold J. Tudor

*Attorney, Agent, or Firm*—Oblon, Spivak, McClelland, Maier & Neustadt

[57] ABSTRACT

The invention relates to warheads including a core-generating charge and rotating about an axis which is not the charge axis. In front of the coating of the charge is positioned a wedge with a straight or curved triangular cross section, for slowing down said coating in a non-isotropic manner. The wedge is further destroyed during the formation of the core.

13 Claims, 5 Drawing Sheets

CORE-GENERATING CHARGE WITH MEANS FOR CORRECTING ENTRAINMENT ROTATION EFFECTS

BACKGROUND OF THE INVENTION

1. Field of the Invention

The present invention relates to ballistic projectiles including a core-generating charge. It relates more particularly to the correction of the effects of a rotation of the warhead about an axis which is not that of the charge.

2. Description of the Related Art

Let us recall that a core generating charge is an explosive charge with a coaxial concave metal coating or lining. The detonation: of the charge causes the concentration of the metal coating on its axis to form a projectile referred to as a core, of high initial velocity, elongated and axisymmetrical.

A core-generating charge is often used together with a target detector which triggers firing of the charge when it detects a target in its line of sight. The detector is then fixedly mounted on a warhead and its line of sight is close to the axis of the charge. Scanning of the target area of such a projectile can be obtained by rotating it about an axis, referred to as the scanning axis, distinct from the detector axis and consequently in general from the charge axis. Upon detection of a target, the charge is quasi-instantaneously ignited : the core is consequently formed in the entrainment kinematic environment existing at this time, i.e., the entrainment velocity of the projectile and its rotational speed about the scanning axis. The resulting disturbance applied to the core is essentially, as will be explained below, a velocity loss applied to the various elements of the coating, which is (linearly) variable along an axis normal to the scanning axis.

SUMMARY OF THE INVENTION

An object of the present invention is a core-generating charge comprising,disposed in Front of the coating, a part with a substantially triangular (straight or curved) cross-section. The function of this part, also called a wedge, is to slow down the coating in a non-isotropic manner and, more specifically, to create on the coating a substantially linear velocity distribution opposing the velocity distribution due to the aforementioned rotational speed, thus neutralizing the most disturbing effects of a rotation by entrainment of the charge.

BRIEF DESCRIPTION OF THE DRAWINGS

Other objects, features and advantages of the present invention will become apparent from the following description given as a non-limitative example with reference to the accompanying drawings, in which.

In these Figures, like references denote like elements.

DESCRIPTION OF THE PREFERRED EMBODIMENTS

Figure 1:
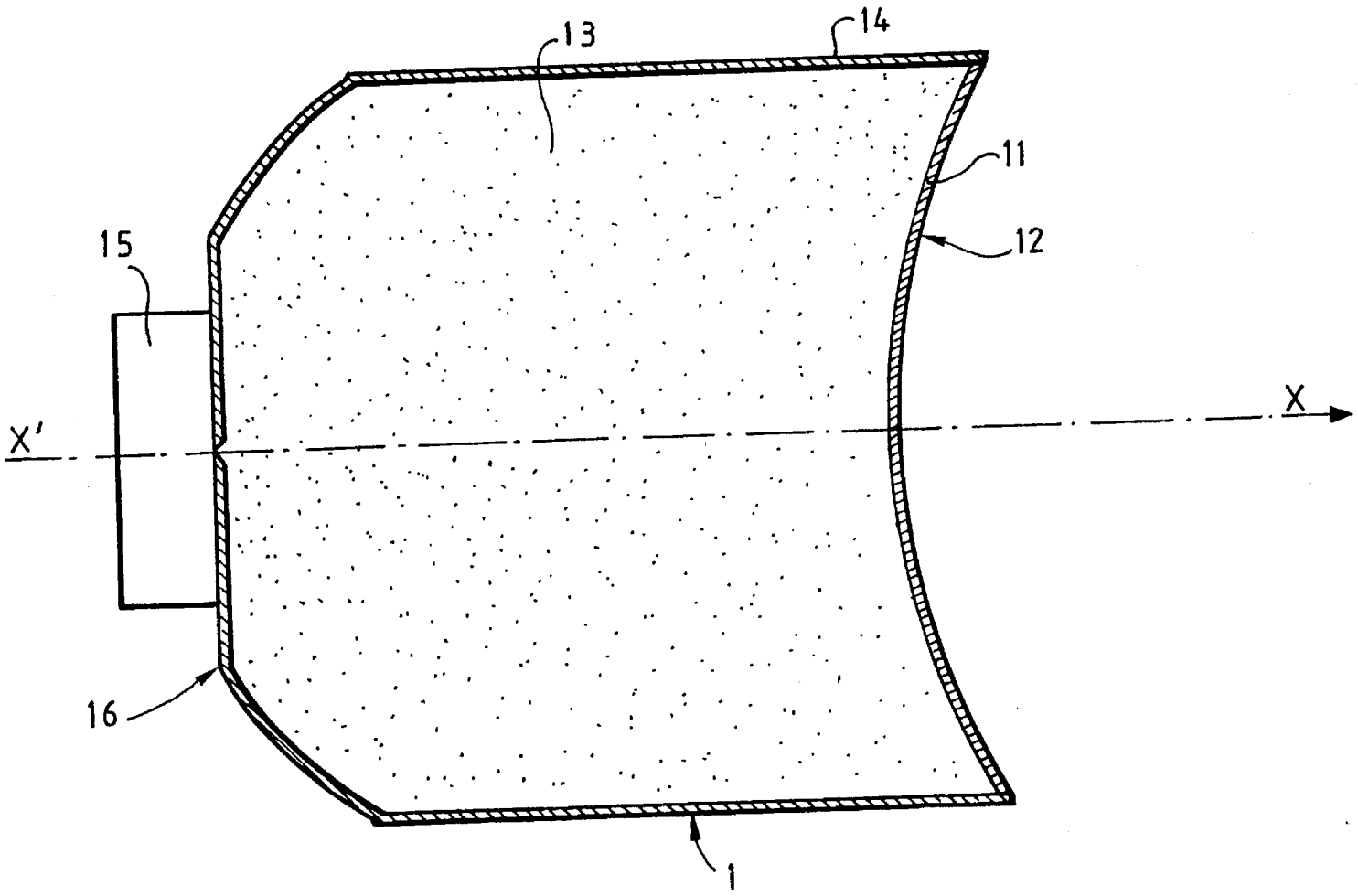
FIG. 1 PRIOR ART
FIG. 1 is a schematic diagram of a conventional core-generating charge.

Referring to FIG. 1, a schematic diagram of a core-generating charge is shown.

A conventional core-generating charge, donoted by 1 in the Figure, includes an explosive charge 13 disposed in an envelope 14, the assembly having a rotational symmetry about an axis X'X directed toward the front side of the charge, The envelope 14 is, for example, cylindrical and closed by a front side 12 and a rear side 16. On the rear side 16, there are disposed means 15 for igniting the explosive 13. The front side 12 is not plane but concave, the surface it forms having a rotational symmetry about the axis X'X, for example a portion of a sphere with the axis X'X, On this front side, a metal coating or lining 11 is disposed.

In operation, the explosive charge 13 is ignited by the means 15, and the detonation wave propagates toward the front side 12 where it causes a projection and concentration (also called collapse) of the metal coating 11 onto its axis X'X, thus forming a core with a rotational symmetry, having a significant axial velocity.

Figure 2:
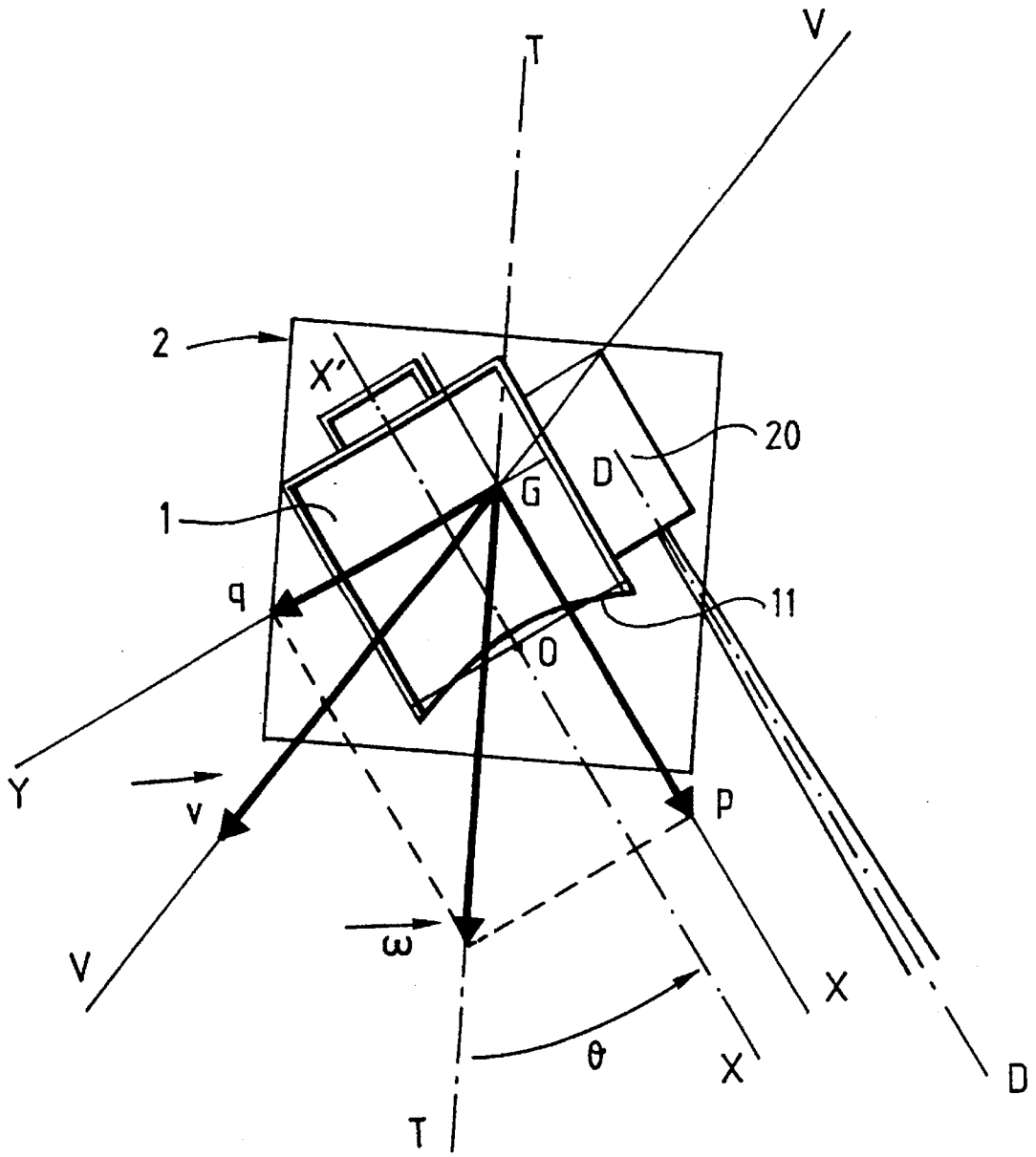
FIG. 2 PRIOR ART
FIG. 2 is a schematic diagram of a warhead including a core-generating charge rotating about an axis which is not that the charge axis.

Referring to FIG. 2, there is shown in a schematical manner and in sectional view an example of a warhead containing a core-generating charge whose axis is not coincident with the axis of rotation of the head, In this Figure, a warhead 2 is shown, for example a substantially cylindrical warhead having an axis of symmetry TT about which the head 2 rotates with an angular velocity ω. The warhead 2 contains the core-generating charge 1 with the axis X'X forming an angle 0 with the axis of the head, as well as detection means 20 intended to detect a target and whose detection axis, or line of sight, DD is parallel to the axis X'X or forms a small angle with the latter.

The warhead moves along a predetermined trajectory, for example in the case off FIG. 2 along an axis VV with a velocity V low as compared to that v which is imparted to the core by the explosion of the charge. The rotation of the head 2 about its axis TT allows the line of sight DD to scan the ground overflown by the warhead. When the detection means 20 detect a target, the charge is ignited quasi-instantaneously and the detonation projects, while concentrating it on the axis X'X, the coating 11 at the velocity v in the foregoing kinematic environment, i.e., the translation velocity V along the axis VV and the rotational speed ω of the charge 1 about the axis TT.

This rotational speed ω breaks down in turn into a roll component p about an axis GX parallel to the charge axis X'X and which is, in principle, not disturbing, and a pitch component q about an axis YG located in the same plane as the axes TT and X'X (the plane of the Figure) and normal to the axis X'X, with G being the center of gravity of the warhead 2.

Figure 3A:
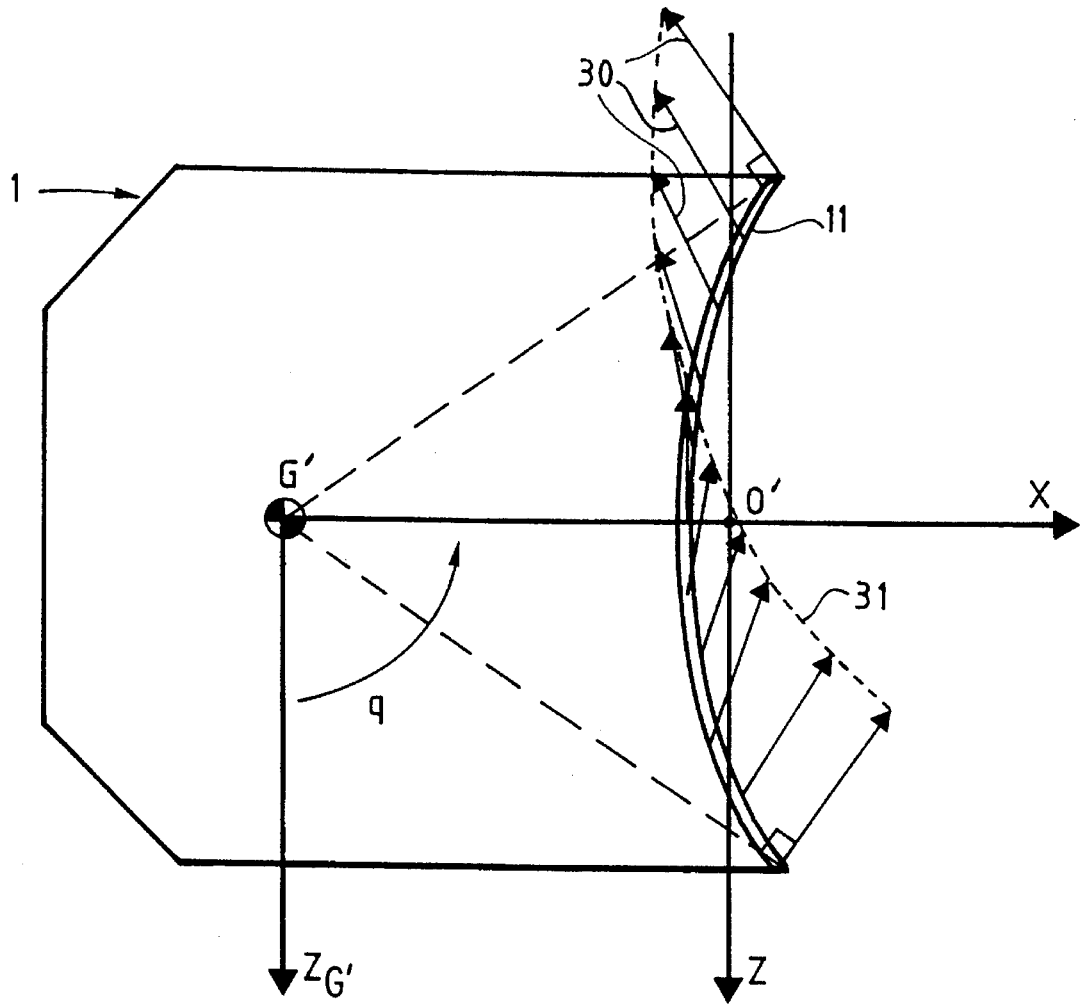
FIGS. 3*a*, 3*b*, 3*c*, 3*d* and 3*e* are explanatory diagrams.

Referring to FIG. 3*a*, a schematic diagram is shown illustrating the velocity distribution induced on the coating 11 by the pitch component q, having an axis GY (not illustrated), through G' which is perpendicular to the plane of the paper.

In this schematic diagram, O' denotes point, through which passes the trace of an axis OY not illustrated parallel to the axis GY and passing through the center of gravity 0 of the coating 11 (FIG. 2). The axis G'X is parallel to the charge axis X'X, and the axis $GZ_G$, is normal to the axis G'X and GY.

The velocity distribution is schematically represented by arrows 30 extending from various points of the coating 11 and a dashed line 31 passing through the end of the arrows.

The distribution is highly non-symmetric along the axis $G'Z_G$, transverse to the charge. For clarity, its various components along the axes O'X and O'Z are shown separately on the subsequent Figures.

Figure 3E:
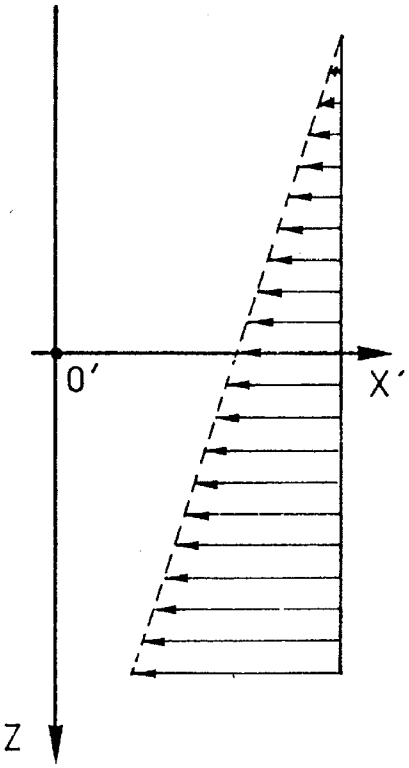
Figure 3D:
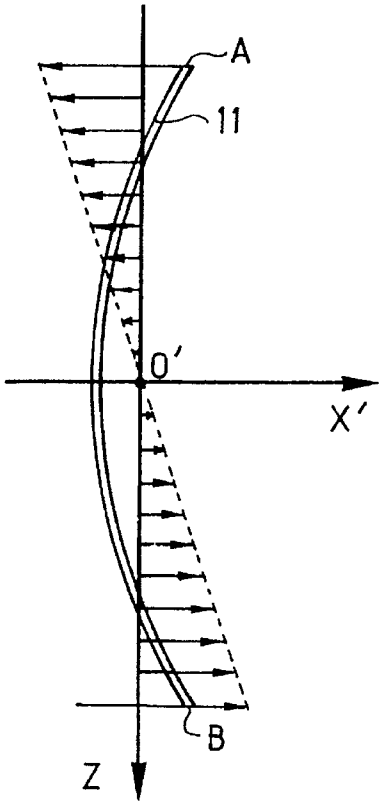
Figure 3C:
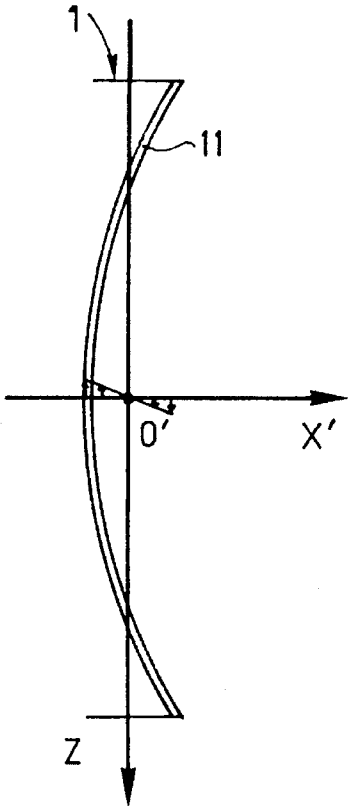
Figure 3B:
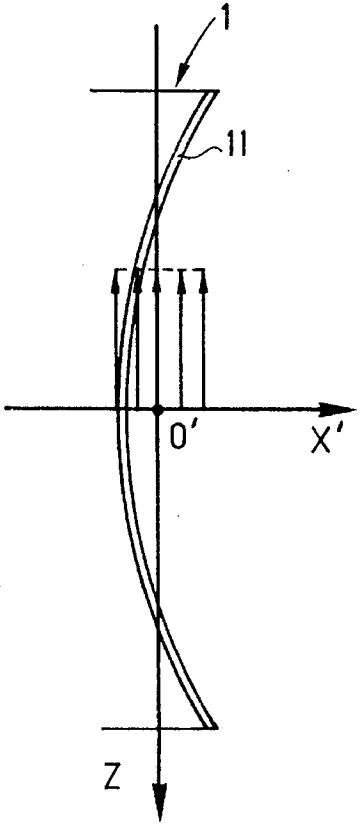

Referring to FIG. 3*b*, the average induced velocity parallel to O'Z of the point 0' located on the not illustrated OY axis is shown.

This distribution is substantially constant and produces a translation of the coating 11 which adds up to the overall velocity V of the head 1. The amplitude is generally small relative to the velocity v imparted to the core by the explosive 13 and this results only in minimal effects that can be neglected.

Referring to FIG. 3*c*, the variable portion of the induced velocity parallel to O'Z is shown.

This rotation adds up to the velocities induced by the roll p in the plane (OY, OZ) of which it destructs the symmetry about the axis OX. The coating 11 having a small concavity, the amplitude of this portion is small in comparison with the initial velocities of the coating collapse.

Referring to FIG. 3*d*, the remainder of the velocity destribution is shown. These velocities parallel to the axis O'X' correspond to the rotation of a plane disk having the same diameter as the coating 11. Their amplitudes, with a linear variation, are maximum at the outer edges A and B of the coating 11 and become zero on the axis OY perpendicular to the plane of the Figure and to the coating axis OX. These velocities may cause a non-negligible asymmetry in the formation of the core if the component q is significant. They give rise to a pitch rotation of the core that the aerodynamic restoring torque, too low, practically not dampens before impact on the target. The incidence angle of the core in flight, which rapidly increases with the component q, can attain high values. The perforating capability thus rapidly decreases.

According to the present invention, to remedy these disadvantages, there is disposed in front of the charge coating a part creating on the latter a velocity distribution opposing the disturbing velocity distribution illustrated in FIG. 3*d*.

This corrective velocity distribution is illustrated in FIG. 3*e*. In this Figure, the axes OX' and OZ' have been represented as above. This is a distribution of velocities parallel to the axis OX', all directed in the negative direction, which means they are slowdown velocities, whose amplitude changes linearly or substantially linearly along the axis O'Z. The amplitude changes along the direction O'Z from a minimum on the side where the velocity induced by the pitch motion (FIG. 3*c*) has the same direction (slowdown) to a maximum on the side where the velocity induced by the pitch motion has the opposite direction, so that the addition of the disturbing (FIG. 3*d*) and corrective (FIG. 3*e*) distributions gives a uniform slowdown velocity over the full area of the coating with an amplitude at least equal to the maximum amplitude of the velocity induced by the pitch motion in the plane (OZ, OX).

Figure 4:
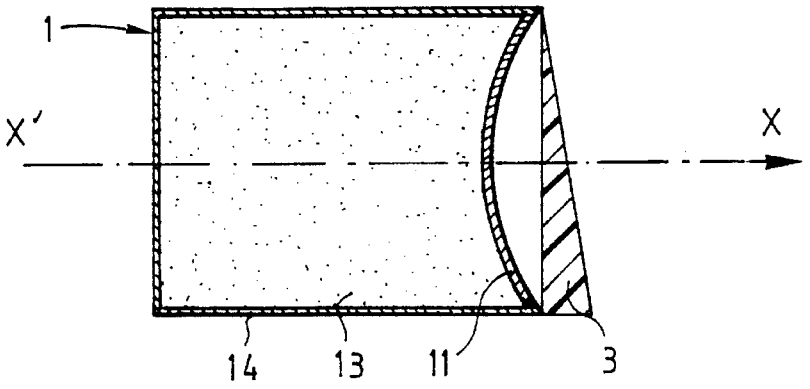
FIGS. 4 through 6 show various embodiments of the charge according to the invention.

Referring to FIG. 4, a first embodiment of the charge according to the present invention is shown, In this Figure, the core-generating charge 1 with its axis X'X and its coating 11 is shown. In front of the coating 11 and resting on the ends of the coating as shown in the Figure, or held at a distance from the latter, a part 3 shaped as a dihedron with a triangular cross section, also called a wedge, is disposed. The function of this part is to produce on the coating, during the formation of the core, a linear velocity distribution as shown in FIG. 3*e*.

In another embodiment, the sides of the dihedron may be convex to obtain a nonlinear variation of thickness of the part 3 so as to take into account the geometry of the cooling at the beginning of the collapse.

The material of the part 3 is preferably rigid so as to be self-supporting, and must be capable of being destructed ted as the cooling moves forward, so as to reduce to the minimum the intensity of the shock induced in the cooling and to facilitate the evacuation of the material of the wedge by regulating it. This can be obtained either with a friable material (rigid polyurethane or polystyrene foam, for example) or with a material thermally destructible when in contact with the cooling healing up under the action of the explosion. This destruction is accompanied by a slowdown proportional to the thickness at each point X. The part is placed as close as possible to the costing 11 to be pushed back at the beginning of the formation of the core, when the coating is still very little distorted and so as to reduce the time of action of the disturbing accelerations due to the rotation in pitch. It is attached by adhesive bonding or by means of spacers and rings resting on the envelope 14 of the charge.

Figure 5:
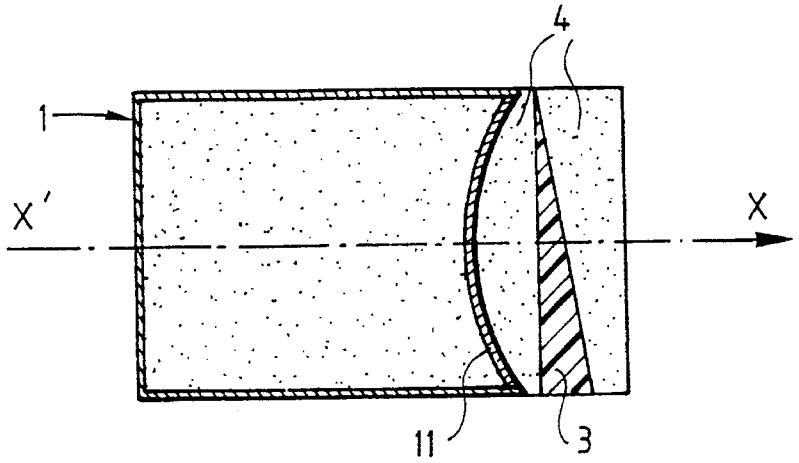

Referring to FIG. 5, another embodiment of the charge according to the invention is shown.

In this Figure, the charge 1, the cooling 11 and the wedge 3 are seen again, but here the latter is disposed and embedded in a supporting material 4 in contact with the coating 11 and with an areal mass negligible with respect to that of the wedge 3 so as not to impair the efficiency of the latter. It may be made of a material with a nature similar to that of the wedge 3. An additional function of the material 4 is to produce a damping and ensure a progressivity of the action of the wedge 3 on the cooling 11. In addition, it helps the wedge 3 in withstanding the mechanical stresses from the environment.

Figure 6:
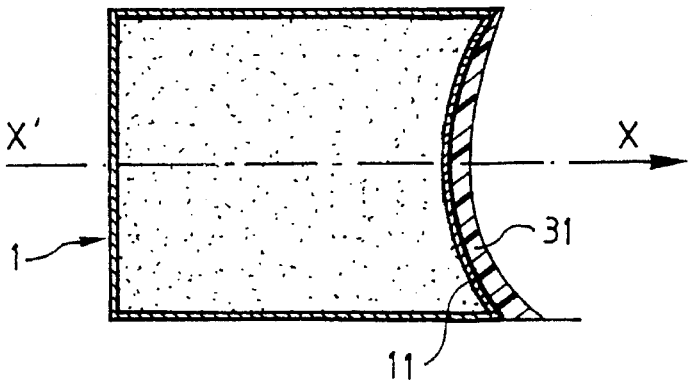

Referring to FIG. 6, a further embodiment of the charge according to the present invention is shown.

In this Figure, the charge 1 with its metal coating 11 is represented. In addition, there is disposed in front of the coating a part 31 with a curved triangular cross section which has the same function as the previous part 3, but whose warped curved shape allows to follow the shape of the coating 11. As above, the part 31 may be disposed as shown in FIG. 6 adjacent to the coating 11 to which it is attached, for example, by adhesive bonding, or on the contrary at a distance therefrom and may be embedded or not in a supporting material such as the material 4 in FIG. 5.

What is claimed is:

1. A core generating charge, comprising an explosive filling within an envelope and a coating laid on one end side of said filling, said charge having a rotational symmetry about its longitudinal axis and having in operation a rotational speed about a second axis distinct from said longitudinal axis, said charge further comprising a wedge with a substantially triangular cross section disposed in front of said coating so as to reduce the effects of said rotational speed.

2. A charge according to claim 1, wherein said wedge is dihedral.

3. A charge according to claim 1, wherein at least one side of said wedge is convex, the variation of thickness being thus not linear in a cross section.

4. A charge according to claim 1, wherein said wedge has a curved triangular cross section.

5. A charge according to claim 1, wherein said wedge is positioned in contact with said coating.

6. A charge according to claim 1, wherein said wedge is not in contact with said coating.

7. A charge according to claim 1, wherein said wedge is embedded in a supporting material disposed in contact with said coating.

8. A charge according to claim 7, wherein said supporting material has a density lower than the density of the material forming said wedge.

9. A charge according to claim 1, wherein said wedge is made of a low-density material.

10. A charge according to claim 1, wherein said wedge is made of a material with a low mechanical strength.

11. A charge according to claim 1, wherein said wedge is made of a rigid material.

12. A charge according to claim 1, wherein said wedge is made of a thermally degradable material.

13. A charge according to claim 1, wherein said wedge is made of a foam of expanded polystyrene or polyurethane.

* * * * *